United States Patent [19]

Stelwagen et al.

[11] 4,169,986

[45] Oct. 2, 1979

[54] TELEVISION CAMERA TUBE HAVING RESILIENT GAUZE SUPPORTING STRUCTURE

[75] Inventors: Jan Stelwagen; Alexius J. T. van Sambeeck, both of Eindhoven, Netherlands

[73] Assignee: U.S. Philips Corporation, New York, N.Y.

[21] Appl. No.: 815,265

[22] Filed: Jul. 13, 1977

[30] Foreign Application Priority Data

Aug. 16, 1976 [NL] Netherlands ..... 7609075

[51] Int. Cl.[2] ..... H01J 29/08; H01J 31/38

[52] U.S. Cl. ..... 313/383; 313/390

[58] Field of Search ..... 313/383, 390, 378, 376, 313/384

[56] References Cited

U.S. PATENT DOCUMENTS

| | | | |
|---|---|---|---|
| 2,909,687 | 10/1959 | Turk et al. | 313/383 X |
| 3,461,336 | 8/1969 | Fuller et al. | 313/378 X |
| 4,004,177 | 1/1977 | van Hattum et al. | 313/383 X |

*Primary Examiner*—Robert Segal

*Attorney, Agent, or Firm*—Algy Tamoshunas

[57] ABSTRACT

If in a television camera tube the gauze-shaped electrode which is tensioned before the signal plate is assembled in a damped mass-spring system, in which the ratio of the mass of said system to the mass of the gauze should be larger than 30, while the fundamental frequency of the gauze and the natural frequency of the mass system differ less than 10% from each other and the damping of the mass spring system is so large that the time necessary for a decrease in amplitude of 20 db of the vibration of the mass of the mass spring system is smaller than 0.5 second, a tube is obtained having a low microphony.

5 Claims, 8 Drawing Figures

TELEVISION CAMERA TUBE HAVING RESILIENT GAUZE SUPPORTING STRUCTURE

The invention relates to a television camera tube comprising in one end of a substantially cylindrical envelope an electron gun opposite to which at the other end a face plate having a radiation-sensitive layer, the so-called signal plate, is situated in front of which signal plate a metal gauze is provided so as to be fixed in a ring, said ring being suspended in the envelope by means of resilient elements.

Such a television camera tube is known from the U.S. Pat. No. 4,004,177 and in which it has been endeavoured to prevent microphony interferences by a dynamic insulation. As a result of so-called stick-slip phenomena in the frequency damping used here, said vibration isolation is not sufficient for small vibration amplitudes. The metal gauge for a 25 mm diameter tube has a mass from 5 to 10 mg. Said metal gauze will vibrate already at a very small amplitude of an interfering impact or vibration and causes a smeared television image.

It has also been tried to increase the damping of the gauze vibration by making the circumferential seal of the gauze which is formed by the tensioning ring so as to be arbitrary with more or less sharp corners instead of the usual circular seal. The effect in this case on the damping is only small, taking into consideration that the fundamental frequency of the gauze is increased by the reduction in area.

It is the object of the invention to provide a television camera tube with very low microphony.

According to the invention, in a television camera tube of the aforesaid kind the ring forms part of a mass spring system vibrating in the longitudinal direction of the envelope. The ratio of the mass of the system to the mass of the gauze exceeds 30, while the fundamental frequency of the gauze and the natural frequency of the mass spring system differs less than 10% from each other. The damping of the mass spring system is so large that the time necessary for a 20 db decrease in amplitude of the vibration of the mass of the mass spring system is smaller than 0.5 second.

The invention is based on the discovery that the introduction of an adapted damped mass spring system between the gauze and the envelope or collector electrode is a simple and effective solution to prevent microphony interferences. The mass of the gauze $m_2$ is small with respect to the mass of the mass spring system $m_1$. The mutual influence of the two vibrating systems:

(1) the gauze having a mass $m_2$ and resilient properties (dependent on the gauze tensioning) but substantially without damping, and (2) the mass spring system having mass $m_1$ and damping coefficient $k_1''$, by suitable choice of the spring material and the shape and connection of the springs, is optimum when the two natural frequencies, the fundamental frequency of the gauze and the natural frequency of the mass spring system are equal or approximately equal. If then the mass $m_1$ decays as a result of the damping in less than 0.1 sec., the mass $m_2$, that is the gauze, will also decay in less than 0.1 second.

A preferred embodiment is a television camera tube in which the mass of the mass spring system consists of the tensioning ring which is secured to the envelope or the collector electrode by means of at least three leaf springs, said leaf springs permitting a movement in the longitudinal direction of the envelope. The mass of the mass spring system may be formed by the tensioning ring alone or by the tensioning ring with an extra mass. By choosing springs having a suitable damping and adapting the mass, the mass spring system can be adapted near the fundamental frequency of the gauze dependent on the dimensions of the tube.

It is alternatively possible to influence the natural frequency by using longer or shorter leaf springs, making the springs thicker or thinner or bending the springs. The natural frequency also depends on the material of the springs.

The tensioning ring usually consists of two parts. It is thus possible to manufacture a part of said tensioning ring and the leaf springs from one assembly, for example, by punching them from a foil.

The invention will now be described in greater detail with reference to a table showing a number of measured results and a drawing, in which FIG. 1 shows diagrammatically a model for the mass spring system with gauze, FIG. 2 is a sectional view of a camera tube according to the invention, FIGS. 3 to 8 show a number of possibilities for the mass spring system.

The frequency of the gauze is denoted by $f_{gauze}$ (in Hz) and the frequency of the mass spring system is denoted by $f_{mass\ spring}$ (in Hz). The decay time $(t_w)$m seconds for a 20 db amplitude decrease, for example, after a forced vibration level of 1 g (10 m/sec$^2$) which is usual in standard tests of microphony phenomena, is recorded in the following table both for the individual gauze and for the gauze with mass spring system.

TABLE

| $f_{gauze}$(Hz) | $t_{u\text{-}gauze}$(sec) | $f_{mass\ spring}$(Hz) | $t_u$ system |
|---|---|---|---|
| 2500 | 9 | | |
| 2500 | | 3900 | 5 |
| 2500 | | 3450 | 3.7 |
| 2500 | | 3000 | 2.2 |
| 2490 | | 2700 | 0.5 |
| 2480 | | 2500 | 0.1 |
| 2550 | | 2150 | 0.2 |

The natural frequency of the mass spring system has been reduced in discrete steps from 3900 to 2150 Hz by increasing the mass of the tensioning ring in a number of steps. The optimum situation in which the lowest decay time ($t_u$=0.1 sec.) for an amplitude decrease of 20 db is obtained is that in which the two frequencies $f_{gauze}$ and $f_{mass\ spring}$ are substantially equal. In comparison with the decay time for an amplitude decrease of 20 db of the gauze alone, namely $t_{u\ gauze}$=9 sec., this is an excellent result. The result becomes even more favourable by a larger damping of the leaf springs.

FIG. 1 is a diagrammatic representation of the double mass spring system which is formed by the tensioned gauze and the spring tensioning ring. The mass of the gauze $m_2$ in combination with the spring having spring constant $k_2$ (which depends on the gauze tension) together determine the natural frequency of the gauze. The tensioning ring having mass $m_1$ and spring with spring constant $k_1'$ determine the natural frequency of said system. For an optimum system it holds that $$(k_2/m_2)=(k_1'/m_1).$$

The damping constant $k_1''$ is determined, for example, by the choice of the material, the connection and the shape of the springs of the tensioning ring. The arrows denote the direction of movement of the envelope 1 and the masses $m_1$ and $m_2$.

FIG. 2 is a sectional view of a television camera tube according to the invention. A tubular envelope is sealed at one end by a face plate 2 on which a radiation-sensitive layer, in this case a photoconductive layer, is provided on the inside. An electron gun (not shown) is provided in the other end 18. Before said photoconductive layer a metal gauze 5 clamped between the rings 4 and 7 is provided, ring 7 comprising leaf springs 6. Said leaf springs are secured to sleeve 8 and/or sleeve 9. By means of sleeve 9 which has an inwardly projecting edge 13 it is possible to adjust the spring constant and the damping of the sleeve springs at the desired value by causing the edge 13 to extend more or less over the leaf springs 6. By means of a ceramic ring 10, the sleeve 8 is positioned in the envelope 1 so as to be insulated by means of the sleeve 12 which has springs 11. The mass $m_1$ (see FIG. 1) is formed by the mass of the tensioning rings 4 and 7 which is suspended by means of leaf springs 6. The damping factor of the system is determined by the kind of material, the dimensions of the springs 6 and the connection of the springs.

Figure 1:
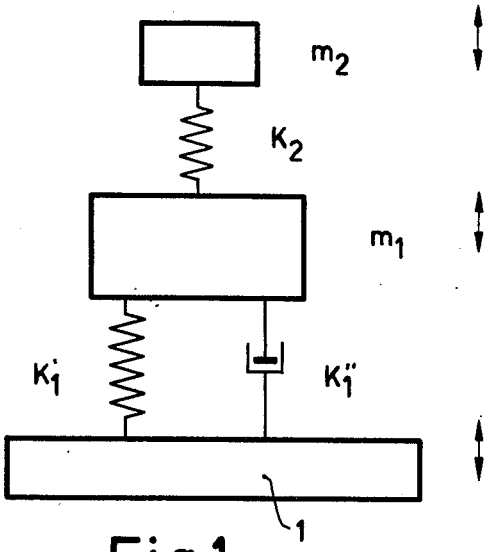
Figure 3:
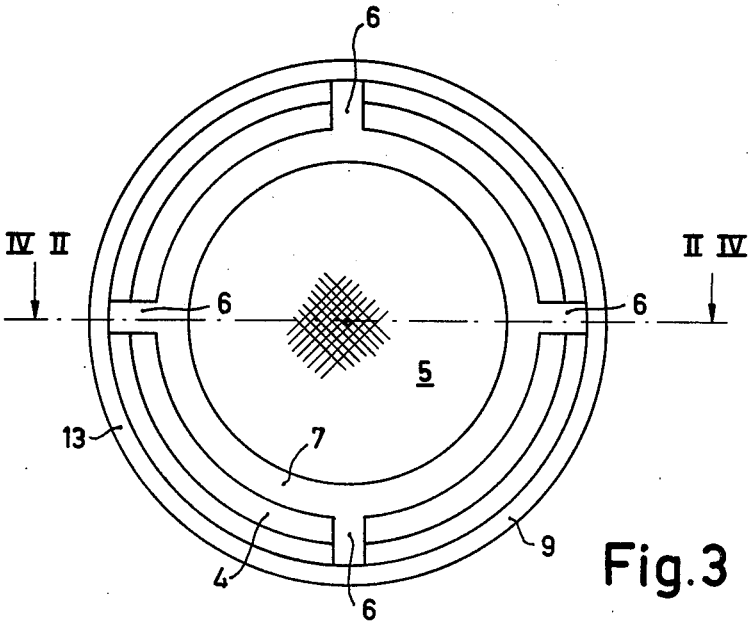
FIG. 3 is a sectional view of a part of a television camera tube where the metal gauze is secured. The ring 7 having leaf springs 6 may be punched from one piece of metal foil.
Figure 4:
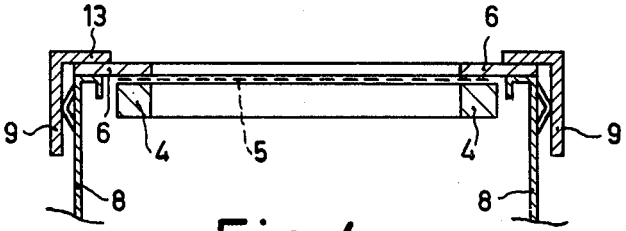
FIGS. 4, 5 and 6 show how it is possible to make the leaf springs longer by bending them.
Figure 2:
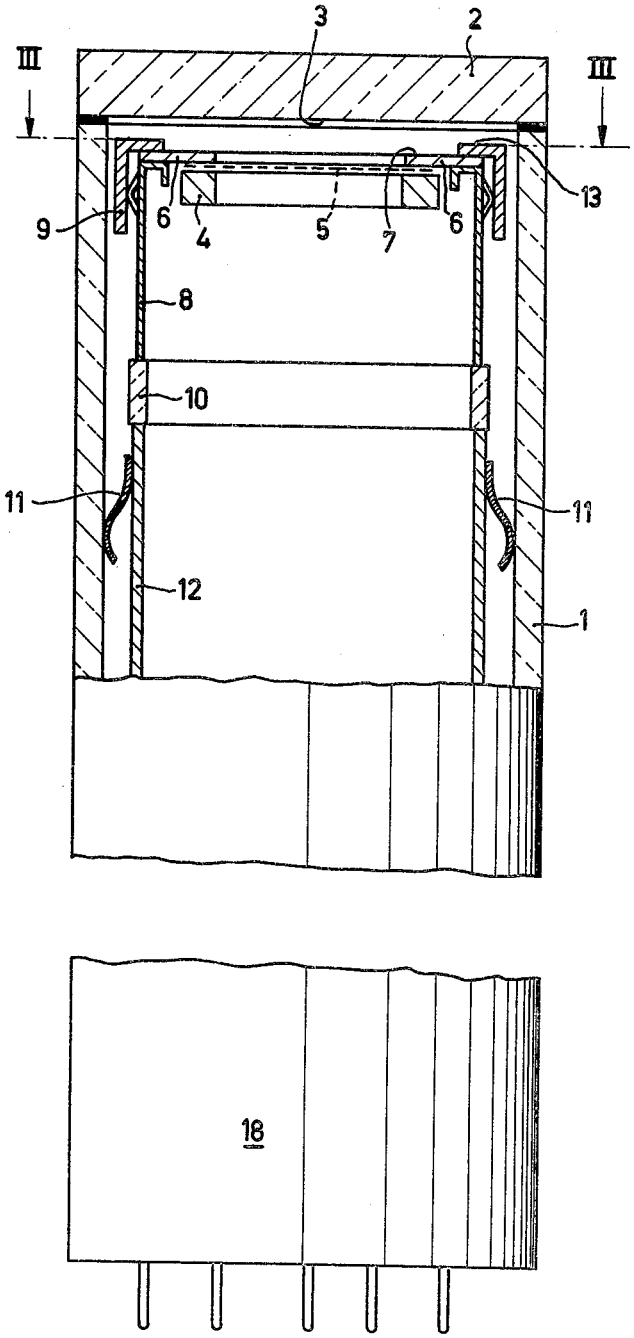
Figure 5:
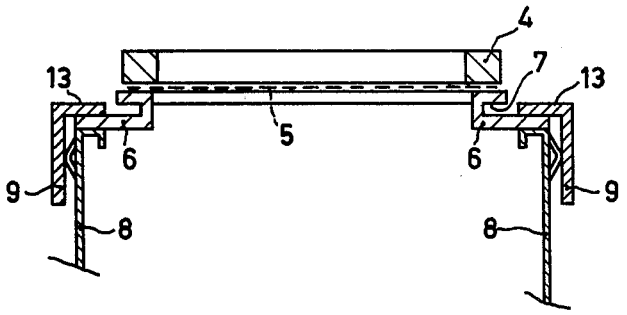
Figure 6:
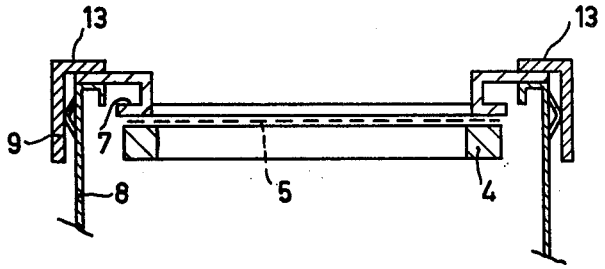
Figure 7:
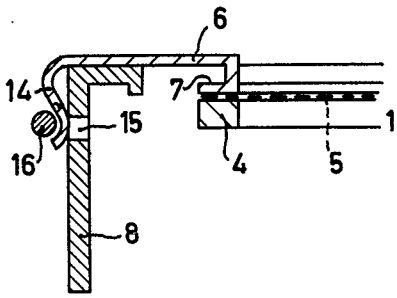
Figure 8:
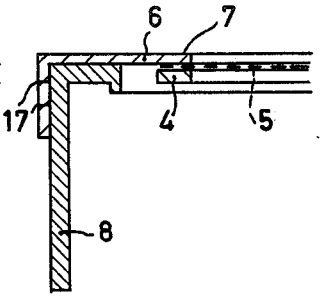

FIGS. 7 and 8 show manners in which the leaf springs 6 can be secured to the sleeve 8. FIG. 7 shows how the leaf spring 6 engage in aperture 15 with their bent end 14 and thus clamp around sleeve 8. The springs are locked by means of ring 16.

FIG. 8 shows how a bent leaf spring can be welded to the outer wall of sleeve 8 by means of spot welds 17.

What is claimed is:

1. A television camera tube comprising a substantially cylindrical envelope, an electron gun in one end of said envelope, a face plate supporting a radiation-sensitive layer at the other end of said envelope facing the electron gun, a metal gauze supported by a tensioning ring, means for resiliently supporting said ring in said envelope between said radiation-sensitive layer and said gun, said supporting means including resilient elements secured to said ring and having portions extending generally perpendicular to the axis of said envelope to form with said ring and said gauze a mass spring system vibrating in the longitudinal direction of the envelope, the ratio of the mass of said system to the mass of the gauze exceeding 30, the fundamental frequency of the gauze and the natural frequency of the mass spring system differing less than 10% from each other and the damping of the mass spring system being so large that the time necessary for a 20 db amplitude decrease of the vibration of the mass of the mass spring system is smaller than 0.5 second.

2. A television camera tube as claimed in claim 1, wherein the mass of the mass spring system consists of the tensioning ring, and at least three leaf springs, securing said ring within said envelope, said leaf springs permitting a movement in the longitudinal direction of the envelope.

3. A television camera tube as claimed in claim 2, wherein the tensioning ring is provided with an extra mass.

4. A television camera tube as claimed in claim 2, wherein the leaf springs are bent.

5. A television camera tube as claimed in claim 2, wherein at least a part of the tensioning ring and the leaf springs constitute one assembly.

* * * * *